US009765654B2

(12) United States Patent
Kobayashi et al.

(10) Patent No.: US 9,765,654 B2
(45) Date of Patent: Sep. 19, 2017

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Masaki Kobayashi, Okazaki (JP); Shohei Masuda, Kariya (JP); Kazuo Ueda, Gamagori (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 146 days.

(21) Appl. No.: 14/772,712

(22) PCT Filed: Dec. 10, 2014

(86) PCT No.: PCT/JP2014/082627
§ 371 (c)(1),
(2) Date: Sep. 3, 2015

(87) PCT Pub. No.: WO2015/098513
PCT Pub. Date: Jul. 2, 2015

(65) Prior Publication Data

US 2015/0377086 A1 Dec. 31, 2015

(30) Foreign Application Priority Data

Dec. 25, 2013 (JP) ..... 2013-267654
Dec. 25, 2013 (JP) ..... 2013-267655

(51) Int. Cl.
*F01L 1/34* (2006.01)
*F01L 1/344* (2006.01)
*F01L 1/053* (2006.01)

(52) U.S. Cl.
CPC ..... *F01L 1/3442* (2013.01); *F01L 2001/0537* (2013.01); *F01L 2001/34459* (2013.01);
(Continued)

(58) Field of Classification Search
CPC ..... F01L 1/3442; F01L 2001/34459; F01L 2001/34466; F01L 2001/34496;
(Continued)

(56) References Cited

U.S. PATENT DOCUMENTS

2002/0043231 A1 4/2002 Hase
2014/0165939 A1 6/2014 Ito et al.
2014/0230762 A1 8/2014 Nakashima

FOREIGN PATENT DOCUMENTS

JP 2002-122009 A 4/2002
JP 2007-198168 A 8/2007
(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) dated Jun. 28, 2016, by the International Bureau of WIPO in corresponding International Application No. PCT/JP2014/082627. (6 pages).
(Continued)

*Primary Examiner* — Zelalem Eshete
(74) *Attorney, Agent, or Firm* — Buchanan Ingersoll & Rooney PC

(57) ABSTRACT

A valve opening/closing timing control device includes a driving rotating body that rotates in synchronization with a crankshaft, a driven rotating body that rotates integrally with a camshaft, a phase detection mechanism that detects the relative rotation phase of the driving rotating body and the driven rotating body, a retarding chamber and an advancing chamber between the driving rotating body and the driven rotating body, a lock mechanism capable of constraining the relative rotation phase to a lock phase, a supply/discharge mechanism that supplies/discharges working fluid to/from the advancing chamber, the retarding chamber, and the lock
(Continued)

mechanism, and a control unit that controls operation of the supply/discharge mechanism. At startup of the engine, if the detected relative rotation phase is not at the lock phase, the control unit controls the supply/discharge mechanism so as to stop successive supply of working fluid to the retarding and advancing chambers.

11 Claims, 8 Drawing Sheets

(52) U.S. Cl.
CPC ..... *F01L 2001/34466* (2013.01); *F01L 2001/34473* (2013.01); *F01L 2001/34476* (2013.01); *F01L 2001/34496* (2013.01)

(58) Field of Classification Search
CPC ..... F01L 2001/34476; F01L 2001/0537; F01L 2001/34473
USPC ..... 123/90.17
See application file for complete search history.

(56) References Cited

FOREIGN PATENT DOCUMENTS

| | | | |
|---|---|---|---|
| JP | 2011-89463 | A | 5/2011 |
| JP | 2013-53616 | A | 3/2013 |
| JP | 5273312 | B1 | 8/2013 |
| JP | 2013-194552 | A | 9/2013 |
| JP | 2013-217339 | A | 10/2013 |

OTHER PUBLICATIONS

Japanese Official Action dated Aug. 25, 2016, by the Japan Patent Office, in corresponding Japanese Patent Application No. 2013-267654 with English language translation (6 pages).

International Search Report (PCT/ISA/210) dated Mar. 3, 2015, by the Japanese Patent Office as the International Searching Authority for International Application No. PCT/JP2014/082627.

Written Opinion (PCT/ISA/237) dated Mar. 3, 2015, by the Japanese Patent Office as the International Searching Authority for International Application No. PCT/JP2014/082627.

VALVE OPENING/CLOSING TIMING CONTROL DEVICE

TECHNICAL FIELD

The present invention relates to a valve opening/closing timing control device that adjusts the opening and closing timing of an intake valve and an exhaust valve by changing the relative rotation phase of a crankshaft and a camshaft included in an internal combustion engine.

BACKGROUND ART

Conventionally, Patent Document 1 listed below describes an example of this type of valve opening/closing timing control device.

In order to be able to swiftly start up an internal combustion engine and be able to start control for changing the relative rotation phase immediately after startup, this device includes a supply/discharge means for supplying and discharging working fluid to and from a phase changing mechanism and a supply/discharge means for supplying and discharging working fluid to and from a lock mechanism. It is described that this device has a configuration in which, particularly when performing startup when the relative rotation phase is at the lock phase, firstly working fluid is supplied to the phase changing mechanism that controls the relative rotation phase, and then after it has become possible to change the relative phase, working fluid is supplied to the lock mechanism to cancel the locked state.

With this configuration, it is possible to supply working fluid to a phase converting mechanism while maintaining the relative rotation phase at the lock phase, which is suited to startup of the internal combustion engine, and it is possible to increase the flow rate of the working fluid so as to complete the operation of filling the phase converting mechanism with working fluid in a short period of time. As a result, the lock mechanism release timing becomes earlier. Furthermore, as a result of releasing the lock mechanism earlier, advancing and retarding control can be performed immediately, and it is possible to obtain a valve opening/closing timing control device that is superior in terms of startup performance and response.

PRIOR ART DOCUMENTS

Patent Documents

Patent Document 1: JP 2007-198168A

DISCLOSURE OF THE INVENTION

Problem to be Solved by the Invention

As with the device in Patent Document 1, control for filling the phase changing mechanism with working fluid is often performed at the same time as startup of the internal combustion engine. In particular, when the temperature of the internal combustion engine is already high, the viscosity of the working fluid is in a state suited to operation, for example, and therefore the control device of the internal combustion engine promptly issues an instruction to start the filling control.

Meanwhile, with a valve opening/closing timing control device that includes a lock mechanism, in order to fix the relative rotation phase at the lock phase for the next instance of startup, control is often performed so as to set the relative rotation phase at the lock phase when the internal combustion engine is stopped, for example. However, it is possible for the internal combustion engine to stop without lock phase control having been completed due to a lock mechanism operation failure or the like.

If filling control is carried out immediately after startup of the internal combustion engine in such a case, there are cases where the internal combustion engine cannot start up as a result of the relative rotation phase largely deviating from the lock phase, and a state of excessive overlap between the intake valve and the exhaust valve, for example, arising.

In view of this, an object of the present invention is to provide a valve opening/closing timing control device that enables an internal combustion engine to swiftly and reliably start up even if the relative rotation phase is not in the lock phase state at the time of startup.

Means for Solving Problem

In a characteristic configuration of a valve opening/closing timing control device according to the present invention, the valve opening/closing timing control device includes:

a driving rotating body that rotates in synchronization with a crankshaft of an internal combustion engine;

a driven rotating body that is arranged coaxially with the driving rotating body so as to be capable of rotating relative thereto, and that rotates integrally with a camshaft for valve opening and closing in the internal combustion engine;

a phase detection mechanism that detects a relative rotation phase of the driven rotating body relative to the driving rotating body;

a retarding chamber that moves the relative rotation phase in an retard direction using volume expansion, and an advancing chamber that moves the relative rotation phase in an advance direction using volume expansion, the retarding chamber and the advancing chamber being formed between the driving rotating body and the driven rotating body;

a lock mechanism capable of constraining the relative rotation phase at a lock phase between a maximum advance phase and a maximum retard phase;

a supply/discharge mechanism that performs supply and discharge of working fluid to and from the advancing chamber, the retarding chamber, and the lock mechanism; and a control unit that controls operation of the supply/discharge mechanism, wherein at a time of startup of the internal combustion engine, if the relative rotation phase detected by the phase detection mechanism is not at the lock phase, the control unit controls the supply/discharge mechanism so as to stop successive supply of the working fluid to the retarding chamber and the advancing chamber.

In the case of a valve opening/closing timing control device in which the relative rotation phase of the driving rotating body and the driven rotating body can be fixed at the lock phase between the maximum advance phase and the maximum retard phase as in the above configuration, the relative rotation phase is often at the lock phase at the time of startup of the internal combustion engine in the case of normal operation. It is often the case that the advancing and retarding chambers have not yet been filled with working fluid at the time of startup of the internal combustion engine, and therefore if the relative rotation phase is at the lock phase, it is possible to perform supply and discharge control for the working fluid such that the supply/discharge mechanism successively supplies working fluid to the advancing chamber or the retarding chamber in an alternating manner so as to fill both of the chambers with the working fluid, thus making it possible to perform a phase change operation thereafter.

However, there are also cases where the lock mechanism does not operate correctly during operation of the internal combustion engine, and there are also cases where the relative rotation phase is not fixed at the lock phase at the time of startup of the internal combustion engine. In view of this, according to the above configuration, the control unit stops the successive supply of the working fluid if the relative rotation phase is not at the lock phase, thus making it possible to prevent the relative rotation phase from being rapidly changed toward the advance side or the retard side due to the start of successive supply, and making it possible to prevent the occurrence of a fault in which the internal combustion engine cannot start up, for example.

The valve opening/closing timing control device according to the present invention is configured for an intake valve, the valve opening/closing timing control device is for an intake valve, and in a case where successive supply of working fluid to the retarding chamber and the advancing chamber is stopped, if the temperature of the internal combustion engine detected by a temperature sensor provided in the internal combustion engine is greater than or equal to a pre-set temperature, the control unit performs retarding control on the supply/discharge mechanism such that the working fluid is supplied to the retarding chamber.

In a valve opening/closing timing control device for an intake valve, if the temperature of the internal combustion engine is high, the ability of fuel supplied to the combustion chamber to self-ignite increases, and there is an increased possibility of ignition occurring before the piston reaches a position suited to ignition in the vicinity of top dead center. In order to prevent this self-ignition, it is preferable that the compression ratio of the cylinder is lowered, for example, in the case where the temperature of the internal combustion engine is high. Even if the compression ratio is lowered, the cranking rotational speed is maintained at a high rotational speed due to the temperature of the working fluid being high, and the internal combustion engine is easily started up. Therefore, according to the above configuration, if the temperature of the internal combustion engine is greater than or equal to a pre-set temperature, and the relative rotation phase is not at the lock phase at the time of startup, the control unit mainly supplies working fluid to the retarding chamber to set the relative rotation phase on the retard side, thus further stabilizing ignition in the internal combustion engine.

The valve opening/closing timing control device according to the present invention may be used for an intake valve, and in a case where successive supply of working fluid to the retarding chamber and the advancing chamber is stopped, if the temperature of the internal combustion engine detected by a temperature sensor provided in the internal combustion engine is lower than a pre-set temperature, the control unit may perform advancing control on the supply/discharge mechanism such that the working fluid is supplied to the advancing chamber.

When the temperature of the internal combustion engine is low, the cranking rotational speed at the time of startup decreases, for example, due to increased viscosity of the working fluid or the like. In this case, if the relative rotation phase were on the retard side, the compression ratio inside the cylinder would decrease. In such a case, there is decreased opportunity for ignition to appropriately occur at the time of cranking, and the startup performance of the internal combustion engine decreases.

Also, if the cam average torque acting on the driven rotating body acts in the retard direction, and the relative rotation phase is not fixed at the lock phase when the internal combustion engine is stopped, for example, the relative rotation phase is often located on the retard side, and this also makes startup difficult.

Therefore, according to the above configuration, if the temperature of the internal combustion engine is lower than a pre-set temperature, and the relative rotation phase is not at the lock phase, it is preferable that the control unit performs advancing control, which is control for mainly supplying working fluid to the advancing chamber so as to return the relative rotation phase toward the lock phase.

The valve opening/closing timing control device according to the present invention may be used for an intake valve, and if the relative rotation phase is fixed at the lock phase due to retarding control performed on the supply/discharge mechanism or advancing control performed on the supply/discharge mechanism, the control unit may control the supply/discharge mechanism such that working fluid is supplied to the retarding chamber and the advancing chamber.

It is not always the case that the advancing chamber or the retarding chamber has been sufficiently filled with working fluid at the stage of retarding control or advancing control. However, if the relative rotation phase is fixed at the lock phase, stable warming-up can be performed regardless of the extent to which the advancing and retarding chambers are filled with working fluid. Note that there are also cases where the internal combustion engine undergoes high-load operation at the end of warming-up or before warming-up ends, and therefore it is necessary to make preparation in order to be able to reliably perform phase control in preparation for such operation.

In view of this, according to the above configuration, if the relative rotation phase is fixed at the lock phase, the control unit restarts the successive supply that it had canceled. Accordingly, it is possible to provide an internal combustion engine that can swiftly respond to various operation requests after operation startup.

The valve opening/closing timing control device according to the present invention can be configured for an intake valve, and if the relative rotation phase is not fixed at the lock phase due to retarding control performed on the supply/discharge mechanism or advancing control performed on the supply/discharge mechanism, the control unit may control the supply/discharge mechanism such that the relative rotation phase is held at a predetermined phase according to the temperature of the internal combustion engine.

If the relative rotation phase cannot be set at the lock phase regardless of starting advancing/retarding control, the relative rotation phase moves past the lock phase and movement toward the maximum advance phase or the maximum retard phase is maintained. This control is for changing the phase to whichever of the advance side and the retard side makes starting easier, and therefore a particularly grave situation does not arise even if the phase continues to move. However, if the pressure of the working fluid rises even a little after cranking, and it is possible to hold the relative rotation phase at a predetermined position, holding the relative rotation phase in the vicinity of the lock phase makes it possible to realize stable operation after startup, and thus is preferable. Therefore, according to the above configuration, if the relative rotation phase cannot be fixed at the lock phase, the control unit controls the supply/discharge mechanism so as to hold a preferable relative rotation phase that corresponds to the temperature of the internal combustion engine at the time, thus further improving the startup performance of the internal combustion engine.

The valve opening/closing timing control device according to the present invention can be configured for an exhaust valve, and if the relative rotation phase is not at the lock phase, and supply of working fluid to the retarding chamber and the advancing chamber is stopped, the control unit may perform advancing control on the supply/discharge mechanism such that the working fluid is supplied to the advancing chamber.

According to the above configuration, the relative rotation phase is controlled to move toward the advance side when the relative rotation phase is not at the lock phase, and therefore the exhaust valve closes when the piston is in the vicinity of top dead center in the intake step of the internal combustion engine, thus making it possible to prevent combustion exhaust gas from entering the inside of the cylinder, and also stabilizing the combustion state. Also, this reduces the overlap between the intake valve and the exhaust valve when the piston is in the vicinity of top dead center, thus raising the compression ratio of the cylinder and making startup easier.

The valve opening/closing timing control device according to the present invention can be configured for an exhaust valve, and after the relative rotation phase reaches the maximum advance phase due to the advancing control, and furthermore the internal combustion engine starts, the control unit may perform retarding control on the supply/discharge mechanism such that the working fluid is supplied to the retarding chamber.

At the time of idle operation, for example, after ignition in the internal combustion engine, it is preferable to set the exhaust valve to somewhat of a retarded phase for the purpose of promoting warmup of the engine, reducing exhaust gas, and the like. In view of this, in the above configuration, if the relative rotation phase is not fixed at the lock phase at the time of startup of the internal combustion engine, the control unit sets the relative rotation phase to the maximum advance phase and starts up the internal combustion engine, and thereafter performs retarding control according to an increase in the hydraulic pressure of the working fluid. Accordingly, this configuration attempts to set the relative rotation phase to the lock phase, and realizes more stable startup of the internal combustion engine.

The valve opening/closing timing control device according to the present invention can be configured for an exhaust valve, and if the relative rotation phase is fixed at the lock phase due to the retarding control, the control unit may control the supply/discharge mechanism such that working fluid is supplied to the retarding chamber and the advancing chamber.

It is not always the case that the retarding chamber has been sufficiently filled with working fluid at the stage of retarding control. However, if the relative rotation phase is fixed at the lock phase, stable warming-up can be performed regardless of the extent to which the advancing and retarding chambers are filled with working fluid. Note that there are also cases where the internal combustion engine undergoes high-load operation at the end of warming-up or before warming-up ends, and therefore it is necessary to make preparation in order to be able to reliably perform phase control in preparation for such operation.

In view of this, according to the above configuration, if the relative rotation phase is fixed at the lock phase, the control unit restarts the successive supply that it had canceled. Accordingly, it is possible to provide an internal combustion engine that can swiftly response to various operation requests after operation startup.

The valve opening/closing timing control device according to the present invention can be configured for an exhaust valve, and if the relative rotation phase is not fixed at the lock phase due to the retarding control, the control unit may control the supply/discharge mechanism such that the relative rotation phase is held at a predetermined phase according to the temperature of the internal combustion engine detected by a temperature sensor provided in the internal combustion engine.

If the relative rotation phase cannot be set to the lock phase regardless of the start of retarding control, even in the case where the phase of the exhaust valve moves past the retard side, there is an increase in the overlap between the exhaust valve and the intake valve when the piston is at a position in the vicinity of top dead center, and the compression ratio of the cylinder decreases. As a result, startup of the internal combustion engine becomes difficult. In view of this, in the above configuration, even if the relative rotation phase cannot be fixed at the lock phase, the control unit performs phase control to control the supply/discharge mechanism so as to be able to fix the phase at a relative rotation phase that corresponds to the temperature of the internal combustion engine at that time. This makes it possible to further improve the startup performance of the internal combustion engine.

The valve opening/closing timing control device according to the present invention can be configured so as to include a motor that drives the crankshaft, wherein at a timing of cranking of the crankshaft, the control unit may determine whether or not the relative rotation phase is at the lock phase.

The determination of whether or not the relative rotation phase is at the lock phase is made using angle sensors provided for the camshaft and the crankshaft, for example. If the phase is determined when operation of the internal combustion engine stops, it is necessary to store the phase state until the next instance of startup, for example, and the device configuration becomes complicated. In view of this, according the above configuration, the control performed by the control unit is control performed after the start of energization at the time of startup, thus eliminating the need to include a special storage device, and making it possible to simplify the device configuration.

The valve opening/closing timing control device according to the present invention can be configured such that the determination of whether or not the relative rotation phase is at the lock phase is made by the control unit when the internal combustion engine is stopped.

In the case of the above configuration, a function is needed to store the relative rotation phase in the period in which the internal combustion engine is stopped, for example. However, since the relative rotation phase has already been determined, the control unit can immediately execute successive supply or shift to cancelation at the next instance of startup. In other words, the time required to shift to startup of the internal combustion engine can consequently be shortened, and the internal combustion engine can be promptly and stably started up.

BEST MODE FOR CARRYING OUT THE INVENTION

Overall Configuration

An embodiment of the present invention will be described below with reference to the drawings.

Figure 1:
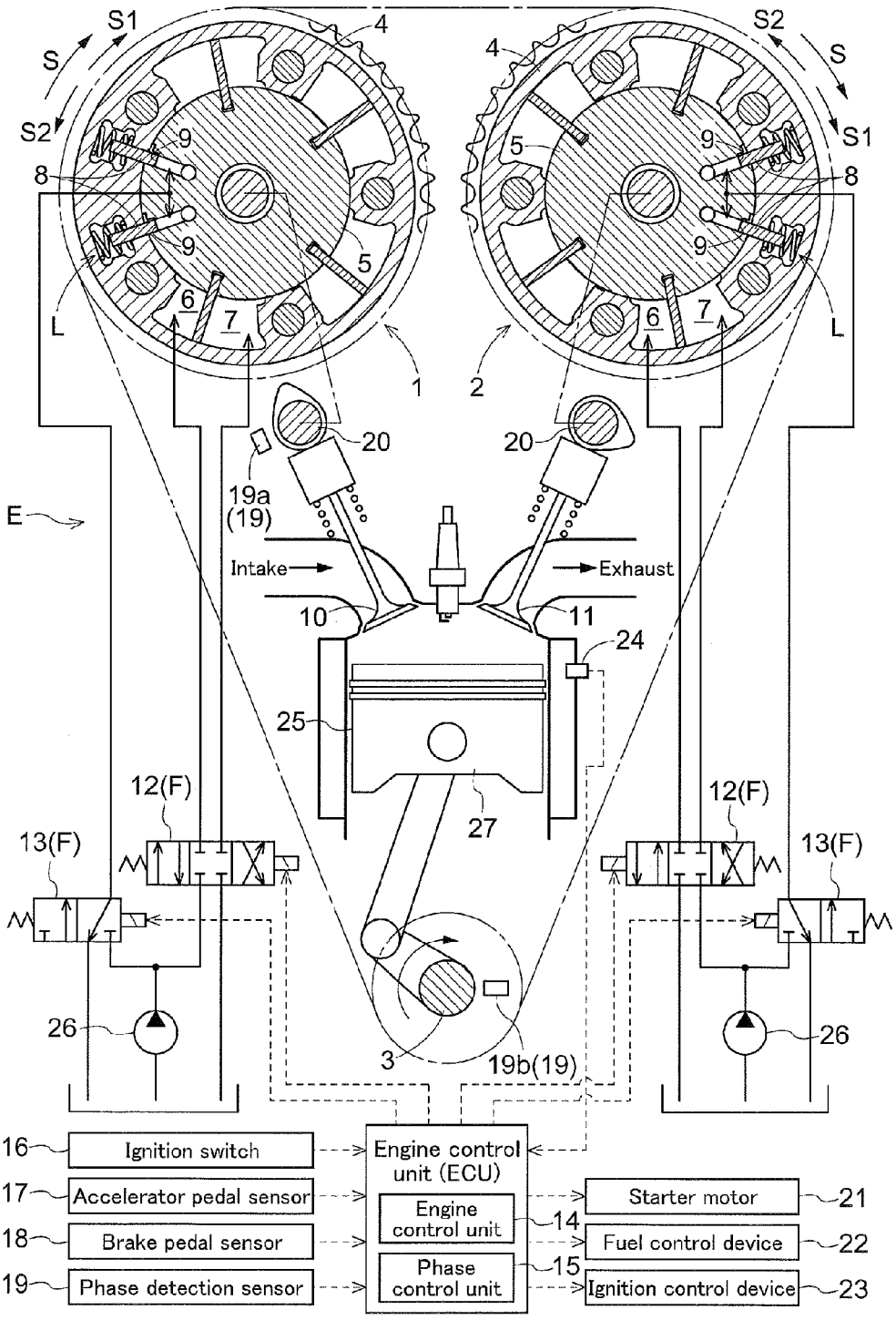
FIG. 1 is an illustrative diagram showing a configuration of a valve opening/closing timing control device according to the present invention.

First, a device configuration according to the present embodiment is shown in FIG. 1.

Specifically, this device includes valve opening/closing timing control devices respectively on an intake valve side and an exhaust valve side (hereinafter, respectively called intake-side VVT-1 and exhaust-side VVT-2 (Variable Valve Timing)). VVT-1,2 each include a driving rotating body 4 that rotates in synchronization with a crankshaft 3 of an internal combustion engine (simply called "engine E" in the embodiment below), and a driven rotating body 5 that is arranged coaxially with the driving rotating body 4 so as to be capable of rotating relative thereto, and that rotates integrally with a camshaft 20.

Also, a retarding chamber 7 and an advancing chamber 6 are formed between the driving rotating body 4 and the driven rotating body 5. In terms of a rotation direction S of the driving rotating body 4, the retarding chamber 7 moves the relative rotation phase in an retard direction S2 using volume expansion, and the advancing chamber 6 moves the relative rotation phase in an advance direction S1 using volume expansion. Working fluid for changing the relative rotation phase is supplied to and discharged from the advancing chamber 6 and the retarding chamber 7 by a supply/discharge mechanism that is described later, and thus the relative rotation phase of the driving rotating body 4 and the driven rotating body 5 is controlled.

Furthermore, lock mechanisms L are provided along the driving rotating body 4 and the driven rotating body 5, and these lock mechanisms L realize stable operation at the time of startup of the engine E and the like by constraining the relative rotation phase of the driving rotating body 4 and the driven rotating body 5 at a lock phase that is between the maximum advance phase and the maximum retard phase. Each lock mechanism L includes a lock member 8 that is retractable and is provided on either the driving rotating body 4 or the driven rotating body 5, and a lock groove 9 that the lock member 8 can be engaged with and released from and that is provided on the other one of the rotating bodies. With this configuration, the lock phase is released when working fluid is supplied from the supply/discharge mechanism to the lock groove 9 so as to push the lock member 8 out from the lock groove 9.

OCVs 12 (Oil Control Valves) that control the relative rotation phase and OSVs 13 (Oil Switching Valves) that control retraction of the lock members 8 are provided as supply/discharge mechanisms F on the intake valve 10 side and the exhaust valve 11 side. These valves switch the supply destination and discharge destination of working fluid by moving a spool that includes a flow passage back and forth by energization of a solenoid.

These devices are controlled by a control unit (ECU: Electronic Control Unit). The ECU includes an engine control unit 14 that controls the ignition system, the fuel system, and the like of the engine E, and a phase control unit 15 that controls the phases of VVT for the intake valve and the exhaust valve. Various types of external devices, such as an ignition switch 16, an acceleration pedal sensor 17, a brake pedal sensor 18, and a phase detection sensor 19, are connected to the ECU. Among these devices, the phase detection sensor 19 is constituted including angle sensors provided for the camshaft 20 and the crankshaft 3.

The ECU calculates an operating condition required of the engine E based on the conditions of various units, and appropriately controls the relative rotation phase of the VVTs while controlling operation of a starter motor 21, a fuel control device 22, and an ignition control device 23 based on the calculation results.

Example of Intake-Side VVT Control

Next, details of intake-side VVT-1 will be described with reference to FIGS. 2 to 5.

Figure 2:
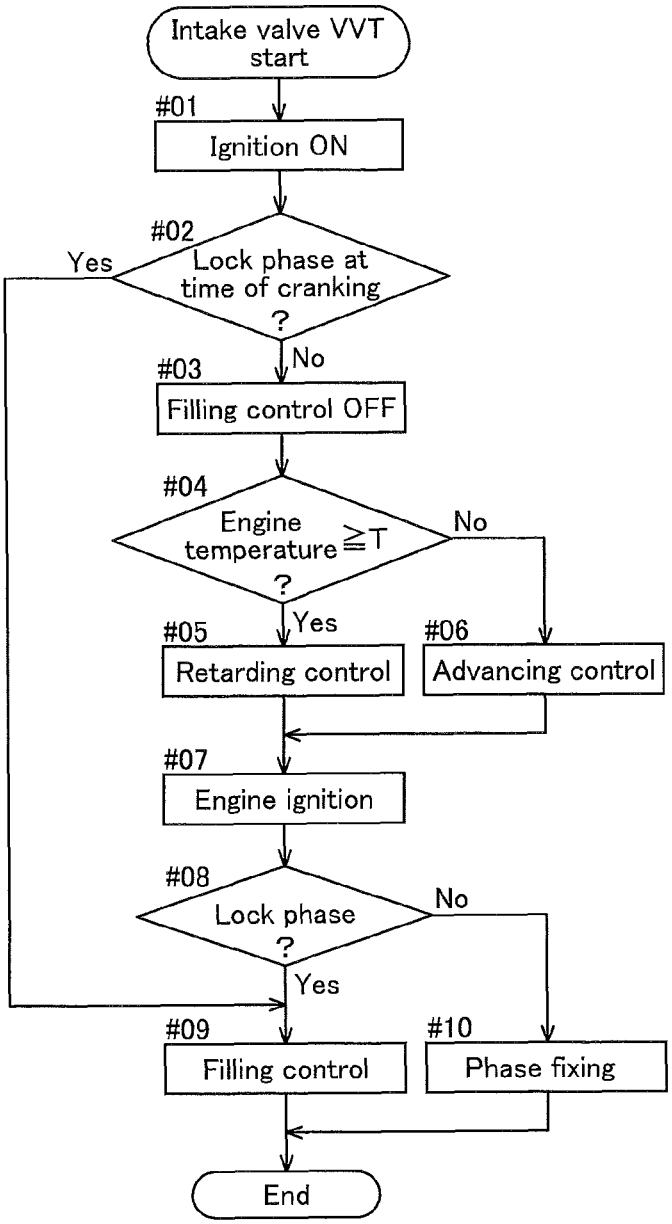
FIG. 2 is a flowchart showing a control mode of an intake valve control device.

FIG. 2 is a flowchart of control in intake-side VVT-1 at the time of engine E startup.

Figure 3:
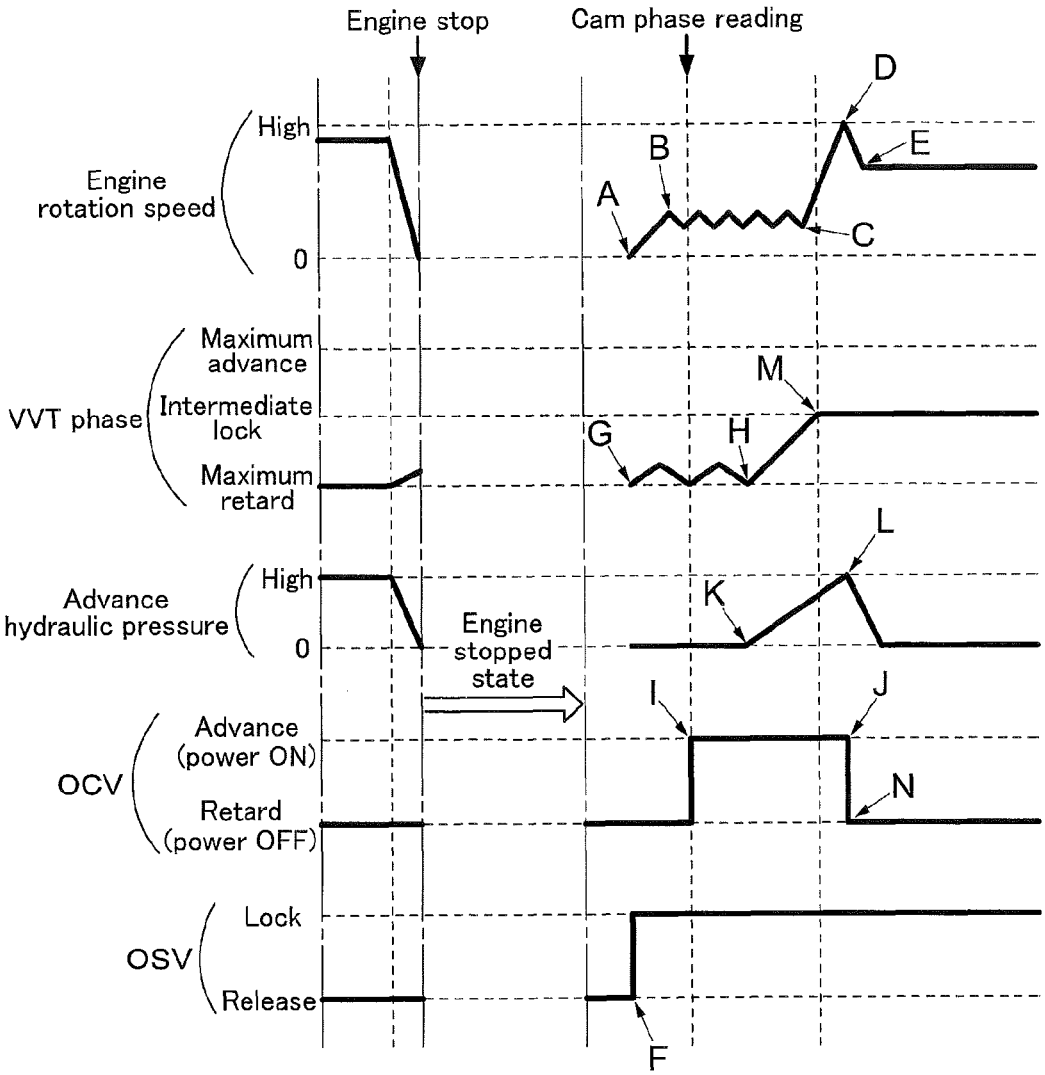
FIG. 3 is a timing chart for intake valve cold startup control when a lock mechanism is operating normally.

First, based on the above flowchart, the following describes the case in FIG. 3, that is to say, VVT control at the time of startup of the engine E in the case where the temperature of the engine E is low and the lock mechanisms L are functioning properly.

As shown in the flowchart of FIG. 2, first the ignition switch 16 is turned on (#01). Accordingly, the starter motor 21 provided along with the crankshaft 3 rotates, and cranking is started.

FIG. 3 shows the engine rotational speed, the VVT phase (relative rotation phase), the advance hydraulic pressure, the operating state of the OCV 12, and the operating state of the OSV 13. Focusing on the engine rotational speed among the above, the ignition switch 16 is turned on at point A, and the state from point B to point C is the cranking state. In the example shown here, ignition occurs at point C, and the rotational speed is somewhat overshot at point D, but then stabilizes at idle rotation at point E.

When cranking is started, the ECU determines whether or not the VVT phase is at the lock phase (#02).

The determination of whether or not the VVT phase is at the lock phase (#02) is specifically made by calculating the VVT phase of the VVT based on detection signals from a cam angle sensor 19*a* provided in the vicinity of the camshaft 20 and a crankshaft sensor 19*b* provided in the vicinity of the crankshaft 3.

Normally, the VVT phase is fixed at the lock phase at the time of engine E startup. For this reason, it is immediately clear that the VVT phase is at the lock phase when an ignition on operation is performed.

If it is determined that the VVT phase is at the lock phase at the time of cranking, filling control (#09) for successively supplying working fluid to the advancing and retarding chambers 6 and 7 is immediately executed.

Accordingly, the advancing and retarding chambers 6 and 7 are filled with working fluid so as to be able to swiftly change the VVT phase in response to various types of operation requests that follow startup of the engine E.

Note that mode of supply of working fluid to the advancing and retarding chambers 6 and 7 in this filling control can be set appropriately. In other words, working fluid is supplied in the state in which the VVT phase is at the lock phase, and therefore the VVT phase does not change. Accordingly, it is sufficient to appropriately operate the OCV 12 in order to be able to fill the advancing and retarding chambers 6 and 7 with working fluid most quickly.

However, if it cannot be confirmed that the VVT phase is fixed at the lock phase during cranking, filling control is canceled (#03).

This is because if an operation for filling the advancing chamber 6 and the advancing chamber 6 with working fluid is performed when the VVT phase is not fixed at the lock phase, the VVT phase changes suddenly, and startup of the engine E becomes difficult.

If the VVT phase is not at the lock phase, the VVT phase needs to be set to some other position that is suited to startup. The startup performance of the engine E is influenced by the engine temperature. Accordingly, the ECU compares the temperature of the engine E with a pre-set threshold value T (#04).

The engine temperature is detected by a temperature sensor 24 provided in the coolant passage, for example. It is then determined whether this temperature is greater than or equal to the threshold value, or lower than it. The threshold value is set to 60° C., for example.

Note that it is sufficient that this threshold value is changed according to the compression ratio of a cylinder 25 of the engine E, the type of fuel, and the like. In other words, this is because if the compression ratio or the like changes, the self-ignition rate during compression also changes, and it is sufficient that the threshold value is appropriately set so as to obtain appropriate startup performance in accordance with individual engines E.

FIG. 3 shows a mode of performing advancing control particularly in the case where the engine temperature is lower than the threshold value T (#06).

If the VVT phase is not at the lock phase at the time of startup, normally it is often located on the maximum retard side. The reason for this is that, because the camshaft 20 is subjected to counter torque toward the retard side by the spring of the intake valve 10 at the same time as the operation for turning off the ignition switch 16, the VVT phase often moves to the retard side if a mechanism for fixing the VVT phase at the lock phase at the time of stopping is not provided.

When the temperature of the engine E is low, the cranking rotational speed at the time of startup, for example, decreases due to increased viscosity of the working fluid, for example. In this case, if the VVT phase were on the retard side, the compression ratio inside the cylinder 25 would also decrease. The startup performance of the engine E decreases in such a case. Also, if the cam average torque acting on the driven rotating body 5 acts toward the retard side, and the VVT phase is not fixed at the lock phase when the engine E is stopped, the VVT phase is located on the retard side, and this also makes startup difficult. Accordingly, it is preferable that if the temperature of the engine E is low, and the VVT phase is not at the lock phase, advancing control is performed to supply working fluid to only the advancing chamber 6.

In FIG. 3, first the OSV 13 is turned on by an ignition on operation (point F) in order to achieve a state in which the lock members 8 of the lock mechanisms L can engage with the driven rotating body 5. Accordingly, the supply of working fluid to the lock grooves 9 provided in the driven rotating body 5 is stopped, and the lock members 8 can be engaged between the driven rotating body 5 and the driving rotating body 4.

Here, the OSV 13 is at a position for supplying working fluid to the lock grooves 9 in the power off state, and thus cancels the lock. Note that besides this, there is also an OSV that is at a position for not supplying working fluid to the lock grooves 9 in the power off state, and therefore it is sufficient that the control mode is appropriately set according to the type of OSV 13 that is used.

The operation of the OSV 13 is also accompanied by the startup of the OCV 12. Due to cranking, the driven rotating body 5 moves back and forth in the advance and retard directions for a short time (from point G to point H). At this time, an oil pump 26 is driven along with rotation of the crankshaft 3, and the OCV 12 is operated in the advance direction (from point I to point J). As the pressure of the working fluid in the advance direction (advance hydraulic pressure) rises (from point K to point L), the VVT phase moves toward the advance side (from point H to point M). Accordingly, the VVT phase is fixed at the lock phase (point M). After the VVT phase is fixed at the lock phase, OCV 12 advancing control is powered off, and control returns to retarding control (point N).

Note that only the advance hydraulic pressure is shown regarding the pressure of the working fluid in FIG. 3. Depending on the case, it is also possible for the VVT phase to be on the advance side of the lock phase at the time of engine startup. However, in this case, there is no need to perform retarding control using working fluid, and the driven rotating body 5 can be easily moved toward the retard side by counter torque from the camshaft 20, and therefore a mode of performing retarding control in a cold state will not be described in particular.

When this stage is reached, it becomes possible to determine the ignition state of the engine E. It is determined whether ignition has occurred based on the rotational speed of the crankshaft 3 or the like (#07).

After the engine E has started rotating continuously, it is again determined whether or not the VVT phase is at the lock phase (#08).

At this stage, it is again checked whether or not the VVT phase is at the lock phase, and if it is fixed at the lock phase, filling control (#09) for supplying working fluid to the advancing and retarding chambers 6 and 7 is restarted.

Accordingly, in the case of performing warming-up after starting, it is possible to fill the advancing and retarding chambers 6 and 7 with working fluid, and prepare for load variation operation thereafter. Although not shown in FIG. 3, when performing filling control, the OCV 12 is alternatingly switched to the retard side and the advance side based on a pre-set mode from point N onward. Accordingly, the advancing and retarding chambers 6 and 7 are quickly filled with working fluid, and it is possible to make preparation so as to be able to immediately change the VVT phase when warming-up ends, for example.

Case of Inability to Fix at Lock Phase

On the other hand, if the VVT phase is not at the lock phase, the OCV 12 is used to perform control so as to hold the VVT phase in the vicinity of a predetermined rotation phase that corresponds to the temperature at that time (#10).

Figure 4:
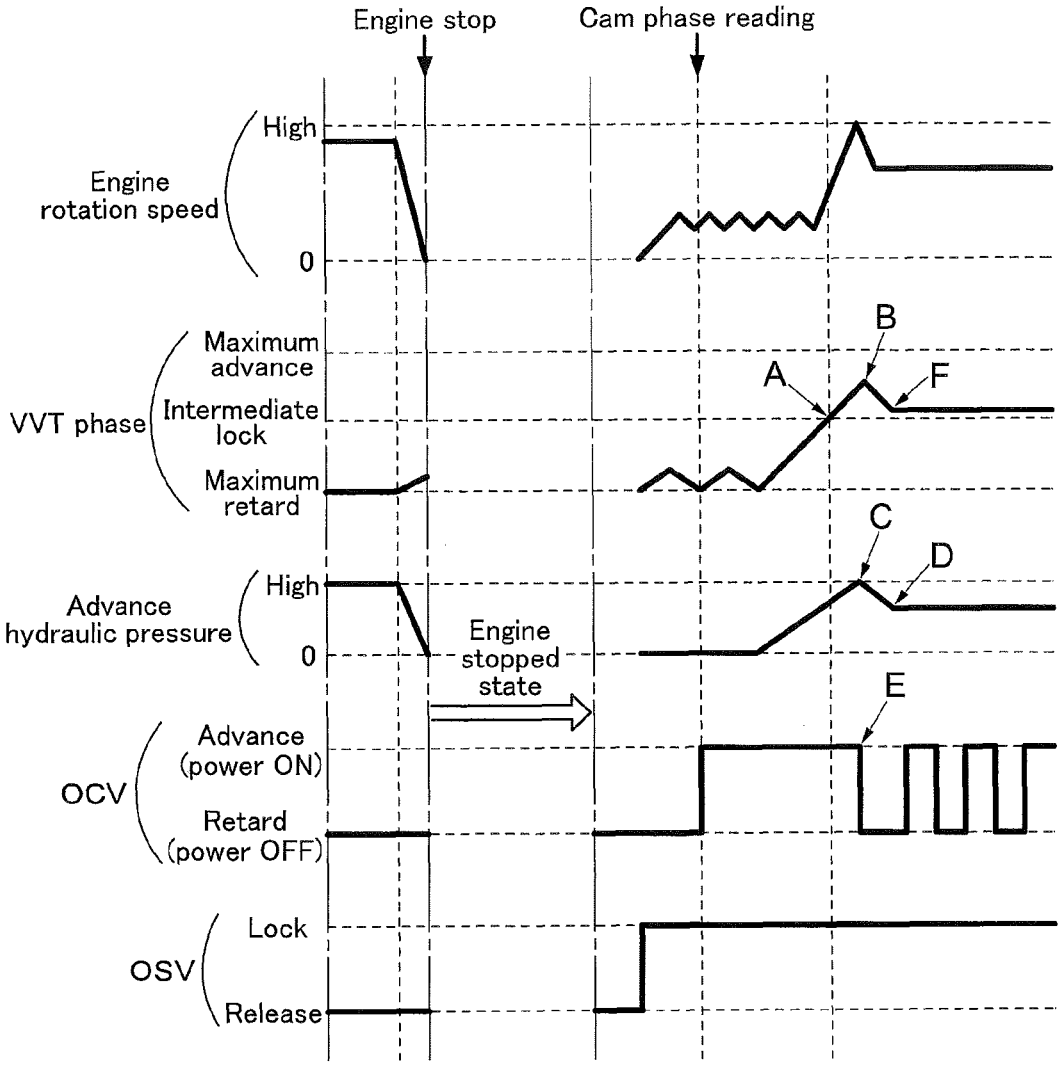
FIG. 4 is a timing chart for intake valve cold startup control when the lock mechanism is inoperative.

The control mode in this case is shown in FIG. 4.

Specifically, FIG. 4 differs from FIG. 3 with respect to the VVT phase, the advance hydraulic pressure, and the operation mode of the OCV 12. More specifically, the VVT phase moves past the lock phase (point A), and the OCV 12 switches to the retard side (point B). Accordingly, the hydraulic pressure supplied to the advance side starts to decrease (points C to D). Thereafter, the OCV 12 repeatedly turns on and off (from point E onward), and as a result, the VVT phase is held somewhat on the advance side of the lock phase (from point F onward).

In this way, if the VVT phase cannot be set at the lock phase regardless of starting advancing/retarding control based on the engine temperature, it is often the case that the VVT phase moves past the lock phase and changes to the maximum advance phase or the maximum retard phase. This control is for changing the phase to whichever of the advance side and the retard side makes starting easier, and therefore a particularly grave situation does not arise even if the phase continues to move. However, if the pressure of the working fluid rises even a little after cranking, and it is possible to hold the VVT phase at a predetermined position, holding the VVT phase in the vicinity of the lock phase makes it possible to realize stable operation after startup, and thus is preferable.

Case of High Engine Temperature

The following describes a control mode in the case where the engine temperature is high in the determination in (#04) in FIG. 2.

Figure 5:
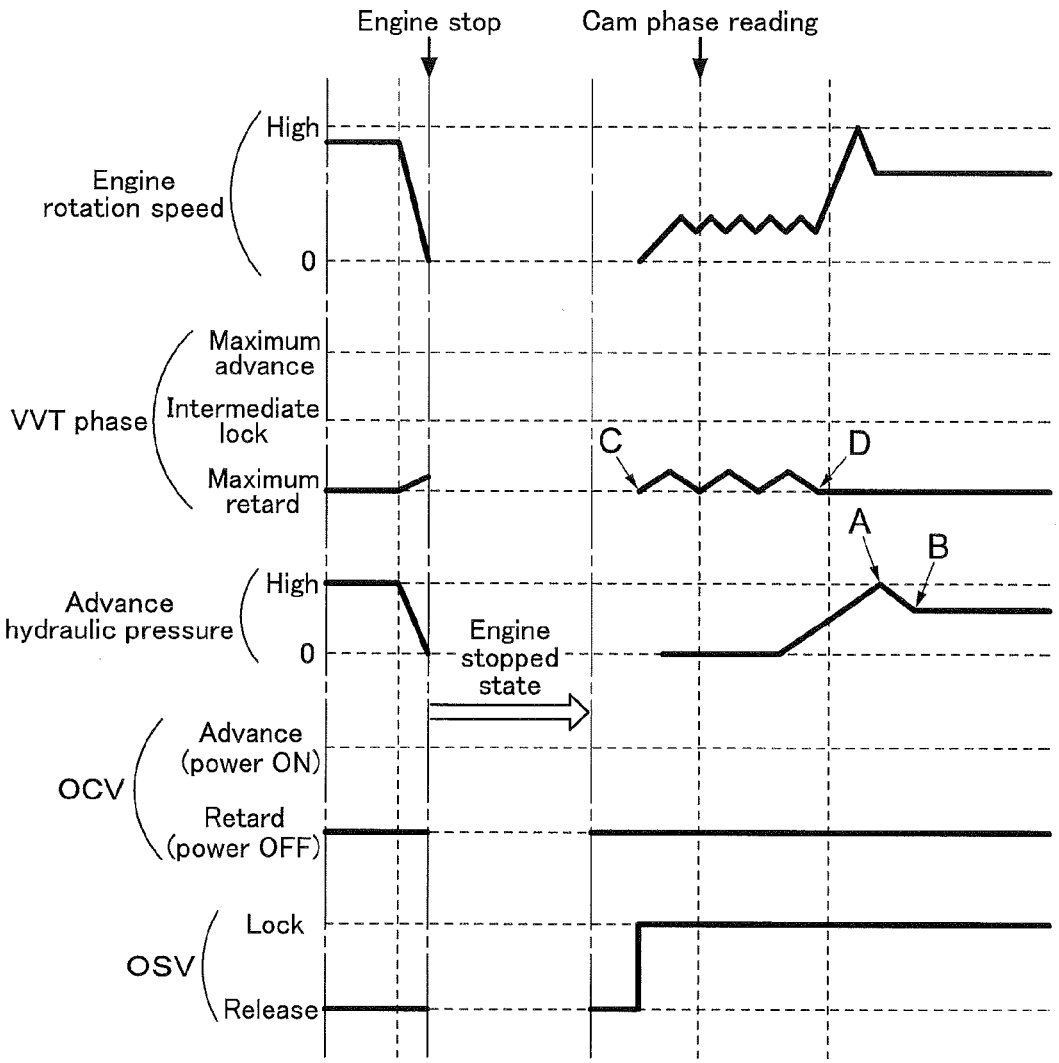
FIG. 5 is a timing chart for intake valve warm startup control.

The control mode in this case is shown in FIG. 5. FIG. 5 and FIG. 3 differ in that the VVT phase is held at the maximum retard phase in FIG. 5.

In the intake-side VVT-1, if the temperature of the engine E is high, there is an increased possibility of ignition occurring before the piston 27 reaches a position suited to ignition in the vicinity of top dead center. In order to prevent this self-ignition, it is preferable that the compression ratio of the cylinder 25 is lowered in the case where the temperature of the engine E is high. Even if the compression ratio is lowered, the cranking rotational speed tends to be maintained at a high rotational speed due to the temperature of the working fluid being high, and the engine E is easily started up. Accordingly, if the temperature of the engine E is high, and the VVT phase is not at the lock phase at the time of startup, working fluid is supplied to only the retarding chamber 7 so as to set the VVT phase to the retard side. This makes it possible to further stabilize ignition in the engine E.

Specifically, the OCV 12 is held under retarding control as shown in FIG. 5. Accordingly, the retard hydraulic pressure reaches the highest pressure (point A), and is held constant thereafter (from point B onward). Accordingly, the VVT phase that had initially been moving back and forth in both the advance and retard directions (points C to D) stabilizes on the maximum retard side (from point D onward), and is held at the maximum retard position thereafter as well.

At the time of warm startup, the engine E can hold the rotating state even in the case where the VVT phase is at the maximum retard phase. Note that attempting to revert to the lock phase in accordance with an increase in the pressure of the working fluid is effective for performing more stable warming-up and the like. In view of this, although not shown in the drawings, a configuration is possible in which the OCV 12 is thereafter subjected to advancing control to attempt reversion to the lock phase, and filling control for filling the advancing and retarding chambers 6 and 7 with working fluid is restarted if the above reversion is successful.

Second Embodiment

Example of Exhaust-Side VVT Control

Figure 6:
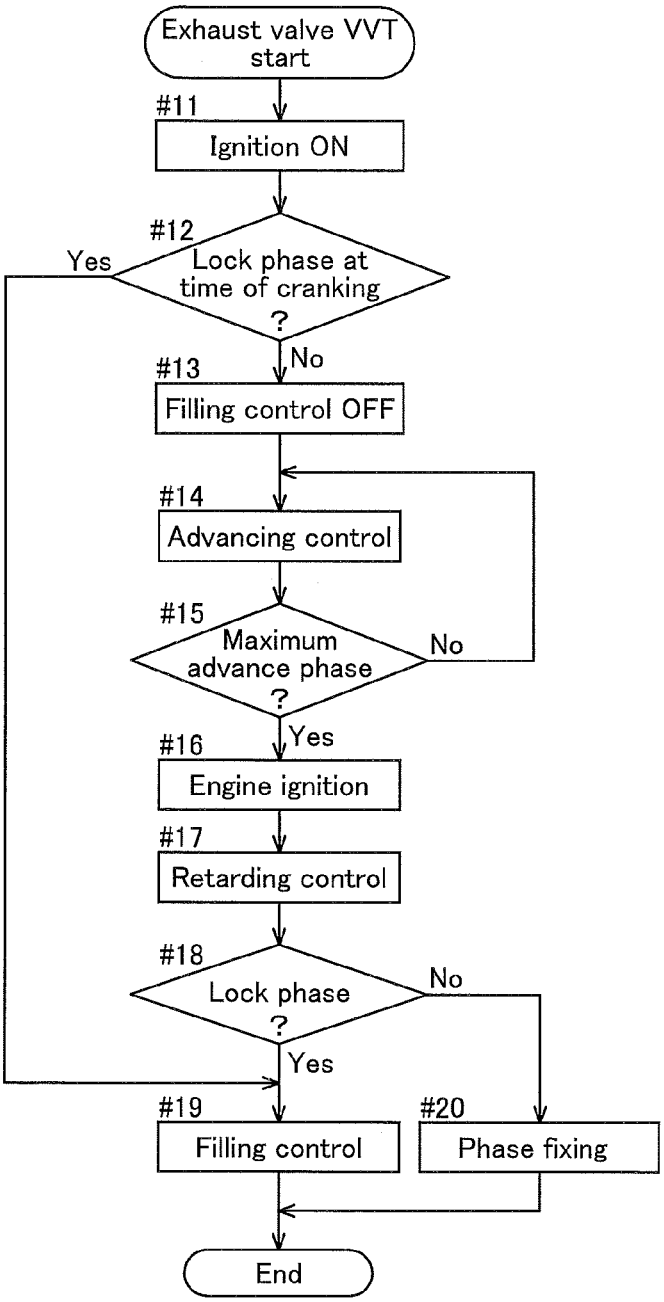
FIG. 6 is a flowchart showing a control mode of an exhaust valve control device.
Figure 7:
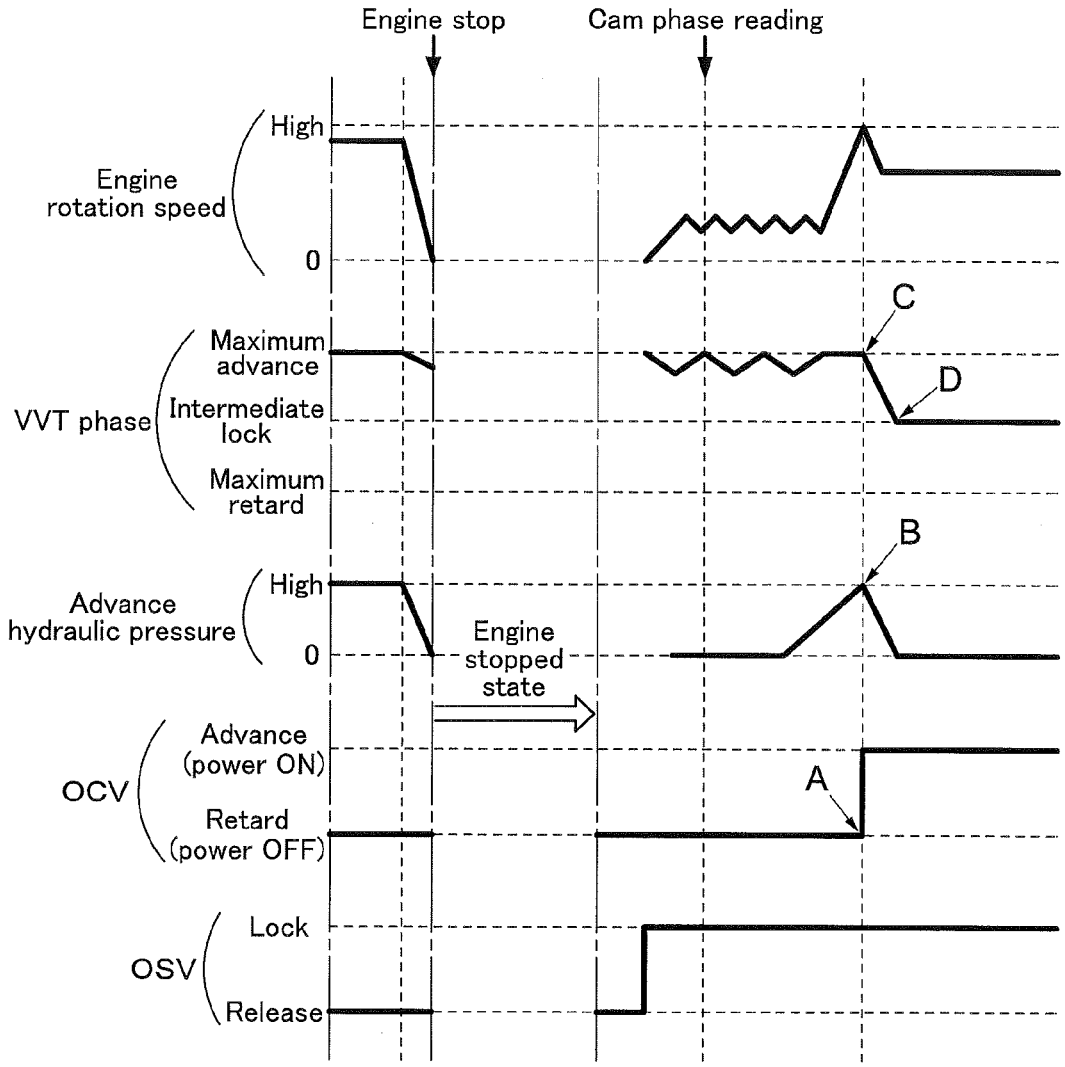
FIG. 7 is a timing chart for exhaust valve startup control when the lock mechanism is operating normally.
Figure 8:
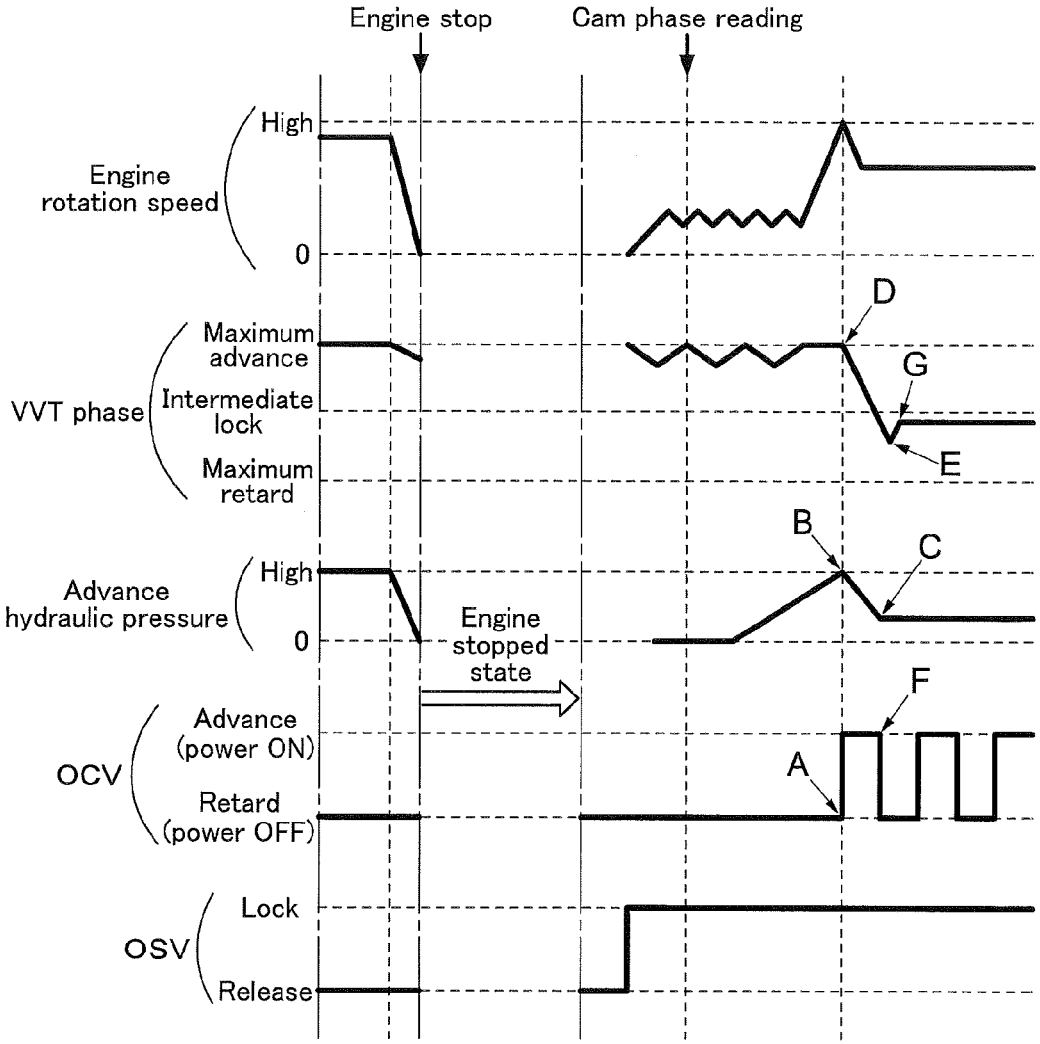
FIG. 8 is a timing chart for exhaust valve startup control when the lock mechanism is inoperative.

The following describes a control mode for the exhaust-side VVT-2 with reference to FIGS. 6 to 8.

The basic mechanical configuration is the same as that of the intake-side VVT-1. What is basically different is that in the exhaust-side VVT-2, the VVT phases are all set to the maximum advance side at the time of engine startup.

FIG. 6 differs from FIG. 2 in that if the VVT phase is not at the lock phase, advancing control is performed regardless of the engine temperature (#14, #15), and in that retarding control is performed after engine ignition (#17).

In the present embodiment, if filling control is stopped while the VVT phase is not at the lock phase (#13), the supply/discharge mechanisms F are subjected to advancing control (#14). This is done so that, specifically, in the intake step of the engine E, the exhaust valve 11 is set to the closed state around the time when the piston 27 passes the vicinity of top dead center, thus preventing combustion exhaust gas from entering the interior of the cylinder 25, and also stabilizing the combustion state. Also, this is done to perform control so as to reduce the overlap between the intake valve 10 and the exhaust valve 11 when the piston 27 is in the vicinity of top dead center, thus raising the compression ratio of the cylinder 25 and making startup easier.

Case of Ability to Fix at Lock Phase

FIG. 7 is a diagram showing a control mode in the case where the lock mechanisms L are functioning properly, and FIG. 8 is a diagram showing a control mode in the case where the lock mechanisms L are not functioning properly. The fact that the VVT phase that was originally in the advance state is switched to the retard state is common in both of these figures.

First, the relationship between FIGS. 6 and 7 will be described. In FIG. 6, the ignition switch 16 is turned on (#11), and when cranking is started, the ECU determines whether or not the VVT phase is at the lock phase (#12). This aspect is the same as in the above case of the intake-side VVT-1. The fact that filling control is executed (#19) if the VVT phase is at the lock phase during cranking, and that filling control is canceled (#13) if it is not confirmed that the VVT phase is at the lock phase is also the same.

Note that as shown in FIG. 7, the OCV 12 is configured so as to perform advancing control in the power off state, and the phase is held in the vicinity of the maximum advance phase immediately after the start of cranking. This is step #14 in FIG. 6. Thereafter, it is checked whether the VVT phase is at the maximum advance phase (#15), and if ignition of the engine E is confirmed (#16), the OCV 12 switches to retarding control (point A in FIG. 7) so as to shift to retarding control (#17). Accordingly, the advance hydraulic pressure starts to decrease (from point B onward), the VVT phase moves toward the lock phase (from point C onward) and is then fixed at the lock phase (point D).

In this way, in the exhaust-side VVT-2, if the VVT phase is not at the lock phase at the time of startup, filling control is stopped, and then startup of the engine E at the maximum advance phase is attempted first. Thereafter, if engine rotation has continued, reversion to the lock phase is attempted.

Case of Inability to Fix at Lock Phase

Note that if the lock mechanisms L are not operating properly as described above, the control mode shown in FIG. 8 is carried out. Specifically, in correspondence with steps #16 to #18 in FIG. 6, in FIG. 8 it is determined that engine ignition has occurred, and then the OCV 12 starts retarding control (from point A onward). Accordingly, the advance hydraulic pressure decreases (points B to C), and the VVT phase also moves to the retard side (points D to E). Note that as a result of the VVT phase passing the lock phase and moving to the retard side in this process (point E), the result of the lock phase determination becomes NO (#18) in FIG. 6. Accordingly, in the phase control, in order to carry out the phase fixing in #20, in FIG. 8 the OCV 12 again performs control for moving to the advance side (from point F onward), the reduction in the advance hydraulic pressure is stopped (point C), and the VVT phase is held at a position slightly deviated to the retard side relative to the intermediate lock phase, for example (from point G onward).

In this way, if the VVT phase cannot be set to the lock phase regardless of the start of retarding control after engine startup, even in the case where the phase of the exhaust valve 11 moves too far on the retard side, there is an increase in the overlap between the exhaust valve 11 and the intake valve 10 when the piston 27 is at a position in the vicinity of top dead center, and the compression ratio of the cylinder 25 decreases. As a result, startup of the engine E becomes difficult. In view of this, as described above, even in the case where the VVT phase cannot be set at the lock phase, phase control is performed so as to enable holding the VVT phase at the vicinity of the lock phase as much as possible, thus making it possible to further improve the startup performance of the engine E.

INDUSTRIAL APPLICABILITY

The present invention can be broadly used with intake-side VVT or exhaust-side VVT among VVTs incorporated in an automobile.

DESCRIPTION OF REFERENCE SIGNS

3: crankshaft
4: driving rotating body
5: driven rotating body
6: advancing chamber
7: retarding chamber
E: engine
L: lock mechanism
S: supply/discharge mechanism

The invention claimed is:

1. A valve opening/closing timing control device comprising:

a driving rotating body that rotates in synchronization with a crankshaft of an internal combustion engine;

a driven rotating body that is arranged coaxially with the driving rotating body so as to be capable of rotating relative thereto, and that rotates integrally with a camshaft for valve opening and closing in the internal combustion engine;

a phase detection mechanism that detects a relative rotation phase of the driven rotating body relative to the driving rotating body;

a retarding chamber that moves the relative rotation phase in an retard direction using volume expansion, and an advancing chamber that moves the relative rotation phase in an advance direction using volume expansion, the retarding chamber and the advancing chamber being formed between the driving rotating body and the driven rotating body;

a lock mechanism capable of constraining the relative rotation phase at a lock phase between a maximum advance phase and a maximum retard phase;

a supply/discharge mechanism that performs supply and discharge of working fluid to and from the advancing chamber, the retarding chamber, and the lock mechanism; and a control unit that controls operation of the supply/discharge mechanism, wherein at a time of cranking of the internal combustion engine, if the relative rotation phase detected by the phase detection mechanism is at the lock phase, the control unit executes filling control for supplying of the working fluid to the retarding chamber and the advancing chamber, and at a time of cranking of the internal combustion engine, if the relative rotation phase detected by the phase detection mechanism is not at the lock phase, the control unit stops filling control for supplying of the working fluid to the retarding chamber and the advancing chamber.

2. The valve opening/closing timing control device according to claim 1, wherein the valve opening/closing timing control device is for an intake valve, and in a case where successive supply of working fluid to the retarding chamber and the advancing chamber is stopped, if the temperature of the internal combustion engine detected by a temperature sensor provided in the internal combustion engine is greater than or equal to a pre-set temperature, the control unit performs retarding control on the supply/discharge mechanism such that the working fluid is supplied to the retarding chamber.

3. The valve opening/closing timing control device according to claim 1, wherein the valve opening/closing timing control device is for an intake valve, and in a case where successive supply of working fluid to the retarding chamber and the advancing chamber is stopped, if the temperature of the internal combustion engine detected by a temperature sensor provided in the internal combustion engine is lower than a pre-set temperature, the control unit performs advancing control on the supply/discharge mechanism such that the working fluid is supplied to the advancing chamber.

4. The valve opening/closing timing control device according to claim 2, wherein the valve opening/closing timing control device is for an intake valve, and if the relative rotation phase is fixed at the lock phase due to retarding control performed on the supply/discharge mechanism or advancing control performed on the supply/discharge mechanism, the control unit controls the supply/discharge mechanism such that working fluid is supplied to the retarding chamber and the advancing chamber.

5. The valve opening/closing timing control device according to claim 2, wherein the valve opening/closing timing control device is for an intake valve, and if the relative rotation phase is not fixed at the lock phase due to retarding control performed on the supply/discharge mechanism or advancing control performed on the supply/discharge mechanism, the control unit controls the supply/discharge mechanism such that the relative rotation phase is held at a predetermined phase according to the temperature of the internal combustion engine.

6. The valve opening/closing timing control device according to claim 1, wherein the valve opening/closing timing control device is for an exhaust valve, and if the relative rotation phase is not at the lock phase, and supply of working fluid to the retarding chamber and the advancing chamber is stopped, the control unit performs advancing control on the supply/discharge mechanism such that the working fluid is supplied to the advancing chamber.

7. The valve opening/closing timing control device according to claim 6, wherein the valve opening/closing timing control device is for an exhaust valve, and after the relative rotation phase reaches the maximum advance phase due to the advancing control, and furthermore the internal combustion engine starts, the control unit performs retarding control on the supply/discharge mechanism such that the working fluid is supplied to the retarding chamber.

8. The valve opening/closing timing control device according to claim 7, wherein the valve opening/closing timing control device is for an exhaust valve, and if the relative rotation phase is fixed at the lock phase due to the retarding control, the control unit controls the supply/discharge mechanism such that working fluid is supplied to the retarding chamber and the advancing chamber.

9. The valve opening/closing timing control device according to claim 7, wherein the valve opening/closing timing control device is for an exhaust valve, and if the relative rotation phase is not fixed at the lock phase due to the retarding control, the control unit controls the supply/discharge mechanism such that the relative rotation phase is held at a predetermined phase according to the temperature of the internal combustion engine detected by a temperature sensor provided in the internal combustion engine.

10. The valve opening/closing timing control device according to claim 1, further comprising a motor that drives the crankshaft, wherein at a timing of cranking of the crankshaft, the control unit determines whether or not the relative rotation phase is at the lock phase.

11. The valve opening/closing timing control device according to claim 1, wherein the determination of whether or not the relative rotation phase is at the lock phase is made by the control unit when the internal combustion engine is stopped.

* * * * *